US006343853B1

(12) United States Patent
Masubuchi et al.

(10) Patent No.: US 6,343,853 B1
(45) Date of Patent: Feb. 5, 2002

(54) ELECTROSTATIC ACTUATOR FOR AN INK JET HEAD OF AN INKJET RECORDING APPARATUS

(75) Inventors: Fumihito Masubuchi; Hirotoshi Eguchi, both of Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 09/458,515

(22) Filed: Dec. 10, 1999

(30) Foreign Application Priority Data

Dec. 17, 1998 (JP) ..... 10-358333
Oct. 20, 1999 (JP) ..... 11-297982

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

FOREIGN PATENT DOCUMENTS

| | | |
|---|---|---|
| JP | 03-293141 | 12/1991 |
| JP | 04-52214 | 8/1992 |
| JP | 07-214770 | 8/1995 |
| JP | 09-20008 | 1/1997 |

OTHER PUBLICATIONS

U.S. Ser. No. 09/346,056, filed Jun. 29, 1999.

*Primary Examiner*—Raquel Yvette Gordon
(74) *Attorney, Agent, or Firm*—Greenberg Traurig, LLP

(57) ABSTRACT

An inkjet recording apparatus has an inkjet head for ejecting a droplet of ink from a nozzle. The inkjet head includes an electrostatic actuator and a diaphragm which are arranged such that the diaphragm is prevented from being destroyed due to an excessive stress or fatigue. A constant amount of displacement of the diaphragm can be achieved even when a voltage fluctuation occurs. The diaphragm is elastically deformable by an electrostatic force. An electrode faces the diaphragm with a predetermined air gap therebetween so as to generate the electrostatic force. The electrode has a width smaller than a width of the diaphragm at all points along a longitudinal direction of the electrode. The electrode is situated under the diaphragm and arranged such that when the electrode is vertically projected onto the diaphragm, the projected electrode is situated within the diaphragm in a direction of the width of the electrode.

21 Claims, 12 Drawing Sheets

ELECTROSTATIC ACTUATOR FOR AN INK JET HEAD OF AN INKJET RECORDING APPARATUS

BACKGROUND OF THE INVENTION

1. Field of the Invention

The present invention generally relates to an actuator and, more particularly, to an electrostatic actuator of an inkjet head provided in an inkjet recording apparatus.

2. Description of the Related Art

An inkjet recording apparatus is used as an image recording apparatus in a printer, a facsimile machine or a copy machine or other such apparatus. The inkjet head includes a plurality of nozzles each of which discharges droplets of ink, a plurality of discharge chambers each of which is connected to a respective one of the nozzles and a plurality of actuators each of which pressurizes ink stored in a respective one of the discharge chambers. The discharge chamber may be a pressure chamber, a pressurizing chamber, a fluid chamber or an ink chamber. Droplets of ink are discharged from each of the nozzles by driving each of the actuators which pressurize the ink stored in the discharge chamber.

An ink-on-demand method is often used in such an inkjet head. According to the ink-on-demand method, droplets of ink (recording fluid) are discharged only when a recording operation is performed, that is, the droplets of ink are actually ejected onto a recording sheet. The inkjet head is classified into one of a plurality of types with respect to generation of droplets of ink and a method of controlling a direction of movement of the droplets of ink.

Japanese Patent Publication No. 4-52214 and Japanese Laid-Open Patent Application No. 3-293141 disclose an electrostatic inkjet head which uses an electrostatic actuator. In this type of inkjet head, a fluid chamber and a diaphragm are formed by etching a first silicon substrate (diaphragm substrate) so that the diaphragm defines a wall of the fluid chamber. A second substrate (electrode substrate) having an electrode is located under the diaphragm substrate so as to define an electrostatic actuator. The diaphragm is deformed by an electrostatic force which is generated by a voltage applied between the diaphragm and the electrode. As a result, the volume of the fluid chamber is changed which results in droplets of ink which are stored in the fluid chamber being ejected.

The driving method of such an electrostatic actuator is classified into one of the two types in accordance with a range of displacement of the diaphragm when the diaphragm is deformed by an electrostatic force. One is a method, such as that disclosed in Japanese Laid-Open Patent Application No. 7-214770, in which the diaphragm is displaced by an amount corresponding to the extent that the diaphragm contacts the electrode. This method is referred to as a contact drive method. The other is a method in which the displacement of the diaphragm is limited to the extent that the diaphragm does not contact the electrode. This method is referred to as a non-contact drive method.

The displacement of the diaphragm driven by the contact drive method is much greater than that of the diaphragm driven by the non-contact drive method in a case in which a gap between the diaphragm and the electrode is the same. Accordingly, the contact drive method is advantageous in that the diaphragm can be driven by a lower voltage than that used in the non-contact drive method when discharging the same amount of ink. Additionally, the contact drive method is superior to the non-contact drive method in that the amount of ink discharged by the displacement of the diaphragm at one time can be uniform since the displacement of the diaphragm is limited by the distance (gap size) between the diaphragm and electrode.

However, according to the contact drive method, the displacement of the diaphragm is larger than that of the non-contact drive method when the same amount of ink is discharged. As a result of such a large displacement of the diaphragm, the contact drive method has a problem in that damage and destruction easily occurs in the diaphragm, especially, due to fatigue. Additionally, the amount of ink discharged from the inkjet head varies greatly due to fluctuation in the voltage applied between the diaphragm and the electrode.

SUMMARY OF THE INVENTION

In order to overcome the problems described above, preferred embodiments of the present invention provide an electrostatic actuator for use in an inkjet head of an inkjet recording apparatus, wherein the actuator is constructed such that a diaphragm is prevented from being damaged or destroyed due to an excessive stress or fatigue, while also maintaining a constant amount of displacement of the diaphragm even when a voltage fluctuation occurs.

According to one preferred embodiment of the present invention, an electrostatic actuator includes a diaphragm which is elastically deformable by an electrostatic force and an electrode facing the diaphragm with a predetermined air gap defined therebetween so as to generate the electrostatic force. The electrode has a width that is smaller than a width of the diaphragm at all points along a longitudinal direction of the electrode. The electrode is located under the diaphragm and arranged such that when the electrode is vertically projected onto the diaphragm, the projected electrode is situated within the diaphragm in a direction of the width of the electrode.

In the electrostatic actuator according to preferred embodiments of the present invention, when the electrode is vertically projected onto the diaphragm, the entirety of the projected electrode may be situated within the diaphragm.

Additionally, a length d of the air gap at an arbitrary point p1 along a side of a top surface of the electrode and a distance L between the point p1 and a point p2 along a side of the diaphragm, wherein point p2 is closest to the point p1, may preferably satisfy a relationship $L/d \geqq 10$. More preferably, the actuator is constructed to satisfy a relationship $L/d \geqq 50$.

Additional elements, features and advantages of the present invention will become more apparent from the following detailed description of preferred embodiments of the present invention when read in conjunction with the accompanying drawings.

DETAILED DESCRIPTION OF PREFERRED EMBODIMENTS

The inventors analyzed fatigue fracture in a diaphragm provided in an actuator of an inkjet head which uses a contact drive method, and discovered that the fatigue fracture is generated mostly in portions near a base of the diaphragm and an edge of an area which contacts an electrode facing the diaphragm. Additionally, the inventors discovered that the above-mentioned fatigue fracture can be prevented by limiting a size of the electrode. The inventors also discovered that the limitation on the size of the electrode can maintain a constant amount of ink ejected from the inkjet head even when variation occurs in the drive voltage applied to the electrode.

Figure 1:
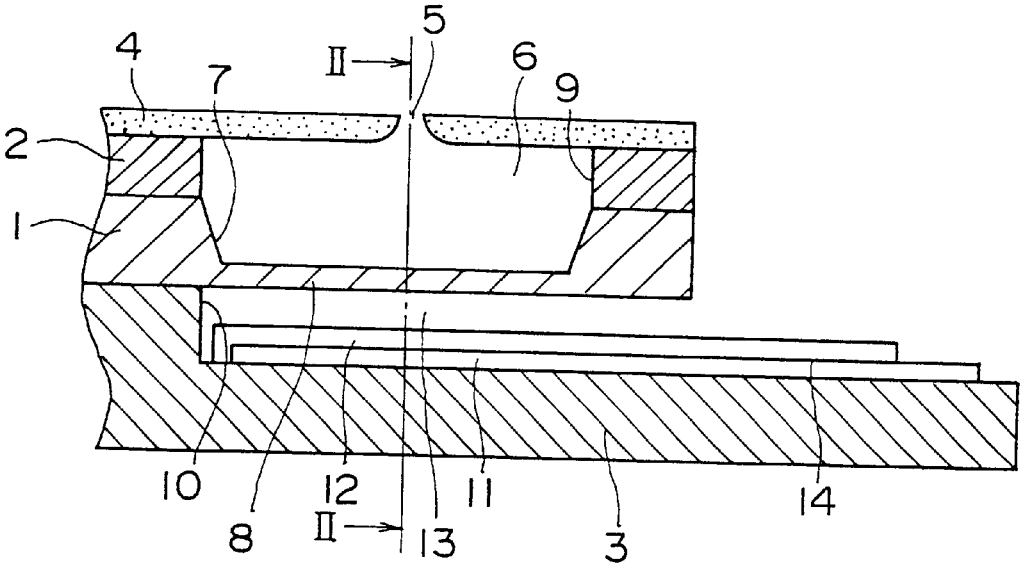
FIG. 1 is a cross-sectional view of a portion of an inkjet head of an inkjet recording apparatus according to a first preferred embodiment of the present invention.
Figure 2:
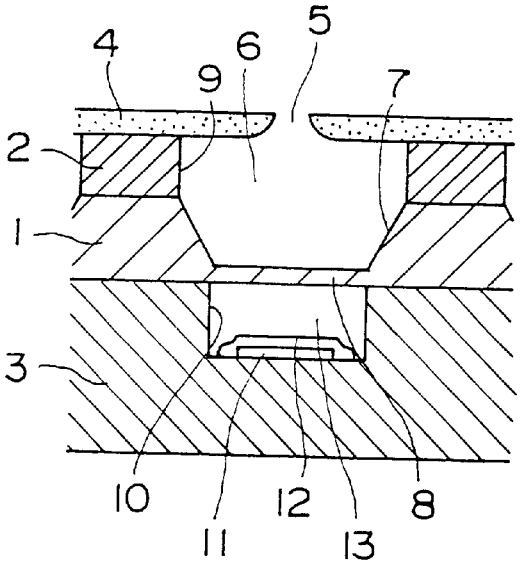
FIG. 2 is a cross-sectional view along line II—II of FIG. 1 of the portion of the inkjet head shown in FIG. 1.
Figure 3:
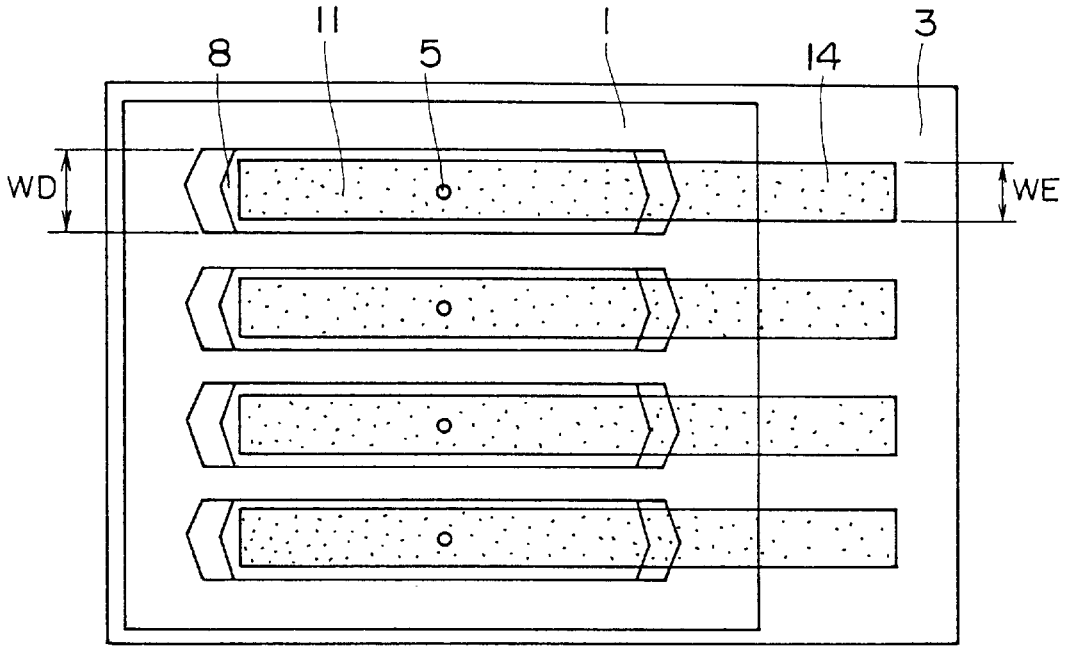
FIG. 3 is a perspective plan view of the inkjet head shown in FIG. 1.
Figure 4:
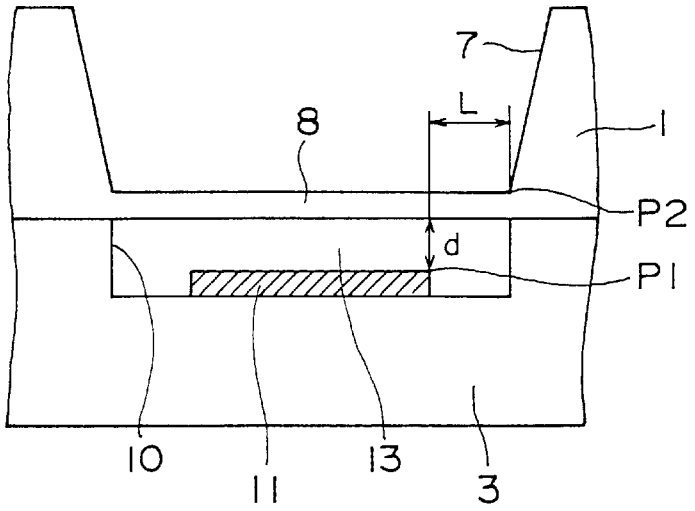
FIG. 4 is a schematic illustration of a portion of the inkjet head shown in FIG. 1 taken along a transverse direction of an electrode.

A description will now be provided of a first preferred embodiment of the present invention. FIG. 1 is a cross-sectional view of a portion of an inkjet head of an inkjet recording apparatus according to the first preferred embodiment of the present invention. FIG. 2 is a cross-sectional view taken along a line II—11 of FIG. 1 of the portion of the inkjet head shown in FIG. 1. FIG. 3 is a perspective plan view of the inkjet head shown in FIG. 1. FIG. 4 is a schematic illustration of a portion of the inkjet head shown in FIG. 1 taken along a transverse direction of an electrode.

The inkjet head shown in FIGS. 1 through 4 preferably includes a diaphragm substrate 1, a fluid chamber substrate 2 located above the diaphragm substrate 1, an electrode substrate 3 located under the diaphragm substrate 1 and a nozzle plate 4 located above the fluid chamber substrate 2. A plurality of fluid pressurizing chambers 6 are provided in the structure constituted by the diaphragm substrate 1, the fluid pressure chamber 2 and the nozzle plate 4. A plurality of nozzles 5 are provided in the nozzle plate 4 so that each of the nozzles 5 is connected to a respective one of the fluid pressurizing chambers 6.

A plurality of depressions 7 are formed in the diaphragm substrate 1 so as to define diaphragms 8. Each of the depressions 7 constitutes a bottom portion of the respective one of the fluid pressurizing chambers 6. Additionally, a common ink chamber (not shown in the figures) provided in the structure is constituted by the diaphragm substrate 1, the fluid chamber substrate 2 and the nozzle plate 4.

The diaphragm substrate 1 is preferably formed of a metal substrate such as a SUS substrate or a silicon substrate. A fine pattern of the fluid chambers is formed in the diaphragm substrate 1 by an etching method. The fluid chamber substrate 2 has a plurality of through openings 9. The fluid chamber substrate 2 is joined to the diaphragm substrate 1 so that each of the through openings 9 constitutes an upper portion of a respective one of the fluid pressurizing chambers 6.

The electrode substrate 3 is provided with a plurality of depressions 10 so that an individual electrode 11 is provided on the bottom of each of the depressions 10. Each individual electrode 11 faces a respective one of the diaphragms 8 with a small air gap 13 (for example, approximately 0.2 $\mu$m) therebetween. Each electrode 11 and the respective one of the diaphragms 8 constitute an actuator which changes a volume of the corresponding one of the fluid pressurizing chambers 6.

An insulating layer 12, which is preferably made of $SiO_2$, functions as a protective film and is formed on each electrode 11 so as to prevent the electrode 11 from being damaged due to a short-circuit or a discharge. Each electrode 11 includes a lead portion 14 extending toward an end of the electrode substrate 3 so that the electrode 11 can be connected to an external drive circuit.

The electrode substrate 3 is preferably formed of a metal plate such as a SUS plate, a glass plate or a silicon plate. The depressions 10 are formed in the electrode substrate 3. The electrode 11 is provided in each of the depressions 10 by depositing an electrode material such as Ni, Al, Ti, Pt or Cu preferably using a thin film forming method such as sputtering or chemical vapor deposition, and thereafter, forming a photoresist layer on the deposited material and etching the deposited material so as to remove portions that are not covered by the photoresist layer.

In the actuator constituted by the diaphragm 8 and the electrode 11, a width WE of the electrode 11 is preferably smaller than a width WD of the diaphragm 8 at any position along the longitudinal direction of the electrode 11 as shown in FIG. 3. Additionally, when the electrode 11 is vertically projected onto the diaphragm 8, the entire electrode 11 is situated within the diaphragm 8 as far as the transverse direction of the electrode 11 is concerned. It should be noted that the transverse direction is a direction that is substantially perpendicular to the longitudinal direction of the electrode 11 or the diaphragm 8, and the width WE of the electrode 11 and the width WD of the diaphragm 8 are measured in the transverse direction.

It should be noted that opposite ends of the diaphragm 8 in the longitudinal direction cannot be perpendicular to the longitudinal direction when the diaphragm 8 is formed via an etching method in a silicon substrate. That is, each of the opposite ends has an angled portion as shown in FIG. 3. However, such an angled portion of the opposite ends of the diaphragm 8 does not influence the advantages achieved by preferred embodiments of the present invention since an amount of displacement of a portion of the diaphragm 8 corresponding to the end of the electrode 11 is smaller than that of other portions of the diaphragm 8. Thus, the angled portion of each of the opposite ends is not included in the entire length of the diaphragm 8 in preferred embodiments of the present invention.

Additionally, when a point P1 is defined at a position along an edge of a side of the electrode 11 and a point P2 is defined at a position along a side of the diaphragm 8 so that the points P1 and P2 are in the same vertical cross section as shown in FIG. 4, a length d of a normal line from the point P1 to the diaphragm 8 and a horizontal distance L between the points P1 and P2 satisfy a relationship $L/d \geqq 10$. More preferably, the relationship $L/d \geqq 50$ is satisfied. It should be noted that the length d of the normal line to the diaphragm 8 corresponds to a length of the air gap 13 between the diaphragm 8 and the electrode 11.

That is, each side of the electrode 11 is offset inwardly from the side of the diaphragm 8 by the length L, and the length L is preferably set to be substantially equal to or greater than about 10 times the length d of the air gap 13. More preferably, the length L is set to be substantially equal to or greater than about 50 times the length d.

The above-mentioned positional relationship is used for the positional relationship between the end side (left side) of the electrode 11 and the end of the diaphragm 8.

It should be noted that a thickness of the insulation layer 12 provided on the electrode 11 is ignored since the thickness is negligibly smaller than the length d. For example, the length d may be about 0.2 $\mu$m whereas the thickness of the insulating layer 12 may be about 0.01 $\mu$m. However, if the thickness of the insulating layer 12 is not negligibly smaller than the length d, the length d should be corrected by subtracting the thickness of the insulating layer 12. That is, the length d corresponds to a length of the air gap within which the diaphragm 8 is displaceable. This length is referred to as an effective gap length.

The nozzle plate 4 is preferably made of a metal plate such as a Ni plate or a SUS plate, a glass plate or a resin plate, and is preferably formed using a conventional etching method or an electro-forming method using Ni. Additionally, a surface of the nozzle plate 4 facing outside is covered by an electroplated film or a water repellent film formed by coating a water repellent agent thereon.

The diaphragm substrate 1, the fluid chamber substrate 2, the electrode substrate 3 and the nozzle plate 4 are joined preferably by an adhesive or a direct bonding method such as an anode bonding or an eutectic bonding method.

In the above-described preferred embodiment of the inkjet head, a drive voltage is applied to the electrode 11 so as to store an electric charge between the electrode 11 and the diaphragm 8 which results in generation of a Coulomb force between the electrode 11 and the diaphragm 8. The drive voltage is sufficiently high for deforming the diaphragm 8 to contact the electrode 11. Accordingly, the volume of the fluid in the pressurizing chamber 6 is increased. Then, by rapidly discharging the electric charge stored between the electrode 11 and the diaphragm 8, the diaphragm 8 returns to its original position by an elastic returning force, which results in a rapid reduction in the volume of the fluid pressurizing chamber 6. Accordingly, the ink in the fluid pressurizing chamber 6 is pressurized, and a droplet of the ink is discharged from the nozzle 5.

After the droplet of the ink is discharged, the drive voltage is applied again to the electrode 11 so as to deform the diaphragm 8 to the extent that the diaphragm 8 contacts the electrode 11. Accordingly, a negative pressure is generated in the fluid pressurizing chamber 6, and, thereby, the ink is supplied to the fluid pressurizing chamber 6 from the common ink chamber through an ink supplying passage (not shown in the figures). After the ink meniscus of the nozzles 5 has reached a stable condition, the operation of the inkjet head proceeds to the next ink-droplet discharging step.

The effects of the above-mentioned limitation in the size of the electrode 11 will be described later.

Figure 5:
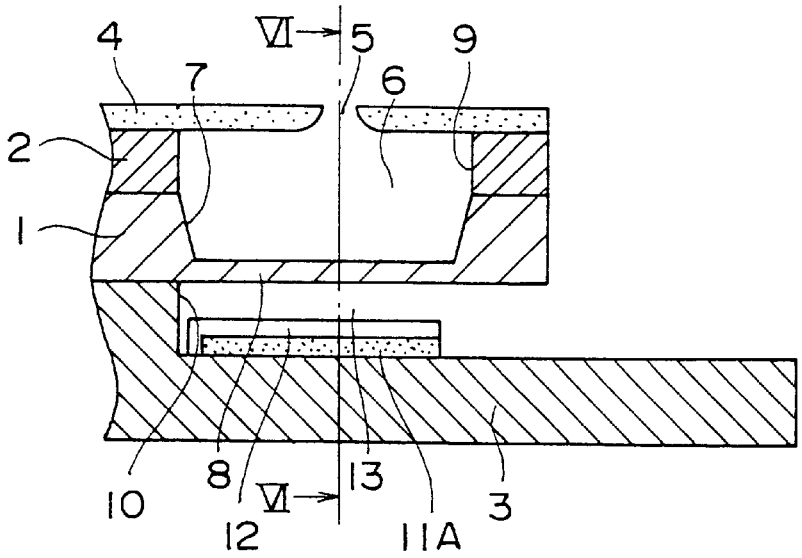
FIG. 5 is a cross-sectional view of a portion of an inkjet head of an inkjet recording apparatus according to a second preferred embodiment of the present invention.
Figure 6:
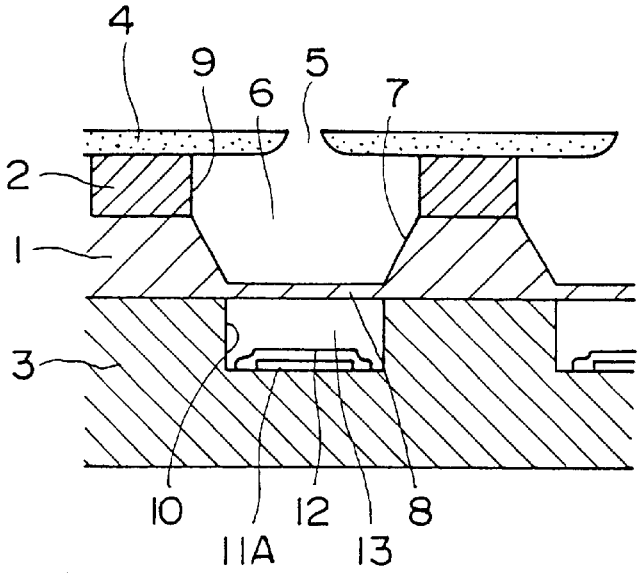
FIG. 6 is a cross-sectional view along line VI—VI of FIG. 5 of the portion of the inkjet head shown in FIG. 5.
Figure 7:
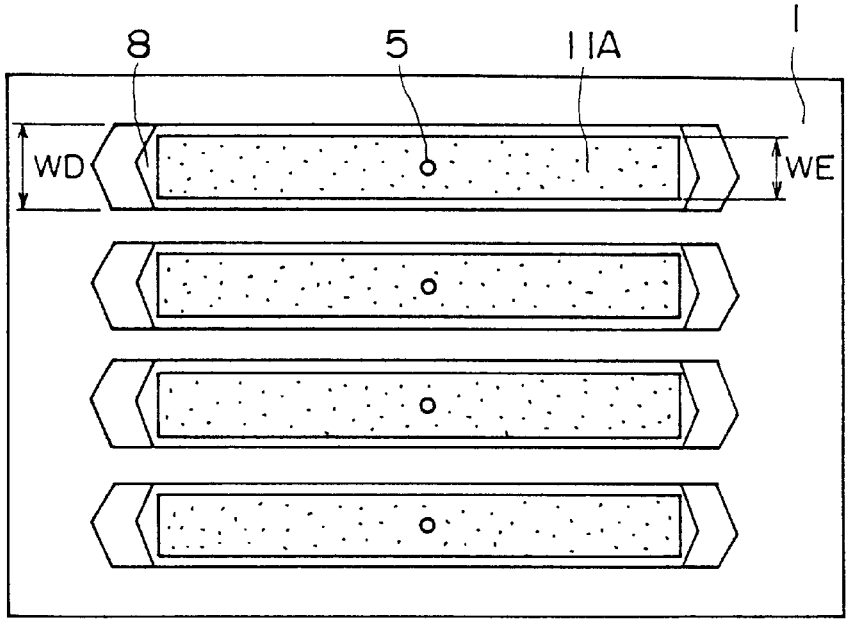
FIG. 7 is a perspective plan view of the inkjet head shown in FIG. 5.
Figure 8:
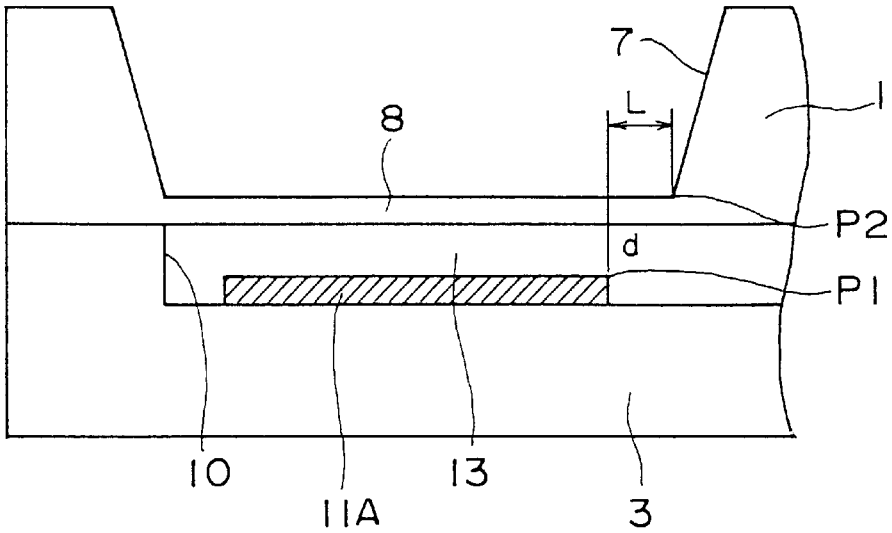
FIG. 8 is a schematic illustration of a portion of the inkjet head shown in FIG. 5 taken along a longitudinal direction of an electrode.

A description will now be provided of a second preferred embodiment of the present invention. FIG. 5 is a cross-sectional view of a portion of an inkjet head of an inkjet recording apparatus according to the second preferred embodiment of the present invention. FIG. 6 is a cross-sectional view taken along a line VI—VI of FIG. 5 of the portion of the inkjet head shown in FIG. 5. FIG. 7 is a perspective plan view of the inkjet head shown in FIG. 5. FIG. 8 is a schematic illustration of a portion of the inkjet head shown in FIG. 5 taken along a longitudinal direction of an electrode. In FIGS. 5 through 8, elements which are the same as those shown in FIGS. 1 through 4 are indicated with the same reference numerals, and descriptions thereof will be omitted.

The inkjet head according to the second preferred embodiment of the present invention preferably has a similar structure as that of the inkjet head according to the first preferred embodiment of the present invention except for the length of the electrode 11 being limited within the diaphragm 8.

That is, as clearly shown in FIG. 7, an electrode 11A provided in the inkjet head according to the second preferred embodiment of the present invention is different from the electrode 11 provided in the inkjet head according to the first preferred embodiment in that the electrode 11A does not have the lead portion 14 extending toward the end of the electrode substrate 3.

Similar to the above-mentioned first preferred embodiment, in the actuator constituted by the diaphragm 8 and the electrode 11A, a width WE of the electrode 11A is preferably smaller than a width WD of the diaphragm 8 at all positions along the longitudinal direction of the electrode 11A as shown in FIG. 7. Additionally, when the electrode 11A is vertically projected onto the diaphragm 8, the entire electrode 11A is situated within the diaphragm 8 as far as the transverse direction of the electrode 11A is concerned. It should be noted that the transverse direction is a direction that is substantially perpendicular to the longitudinal direction of the electrode 11A or the diaphragm 8, and the width WE of the electrode 11A and the width WD of the diaphragm 8 are measured in the transverse direction.

Additionally, when a point PI is defined at a position along an edge of an end side of the electrode 11A and a point P2 is defined at a position along an end side of the diaphragm 8 so that the points P1 and P2 are in the same vertical cross section as shown in FIG. 8, a length d of a normal line from the point P1 to the diaphragm 8 and a horizontal distance L between the points P1 and P2 preferably satisfy a relationship $L/d \geqq 10$. More preferably, the relationship $L/d \geqq 50$ may be satisfied. It should be noted that the length d of the normal line to the diaphragm 8 corresponds to a length of the air gap 13 between the diaphragm 8 and the electrode 11A.

That is, the end side of the electrode 11 is offset inwardly from the end of the diaphragm 8 by the length L, and the length L is preferably equal to or greater than about 10 times the length d of the air gap 13. More preferably, the length L is preferably equal to or greater than about 50 times the length d.

The above-mentioned positional relationship is used for the positional relationship between each side of the electrode 11A and the corresponding side of the diaphragm 8 as with the inkjet head according to the above-mentioned first preferred embodiment.

It should be noted that, in FIG. 8, a thickness of the insulating layer 12 provided on the electrode 11A is ignored since the thickness is negligibly smaller than the length d.

Other structural details and arrangements of the inkjet head according to the second preferred embodiment of the present invention are preferably the same as that of the inkjet head according to the first preferred embodiment of the present invention, and descriptions thereof will be omitted.

Figure 9:
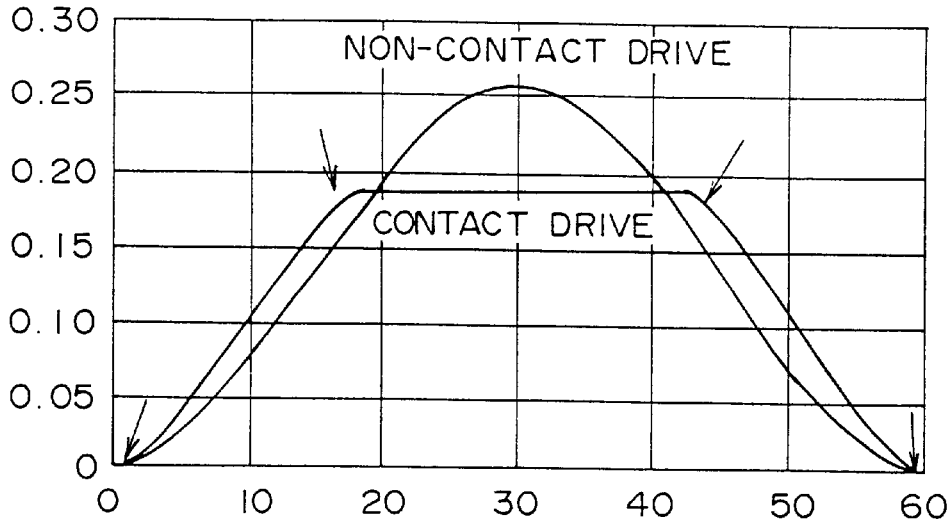
FIG. 9 is a schematic diagram showing an amount of displacement of a diaphragm when the diaphragm is driven by a contact drive method and a non-contact drive method in a case in which the same amount of ink is discharged from the inkjet head.
Figure 10:
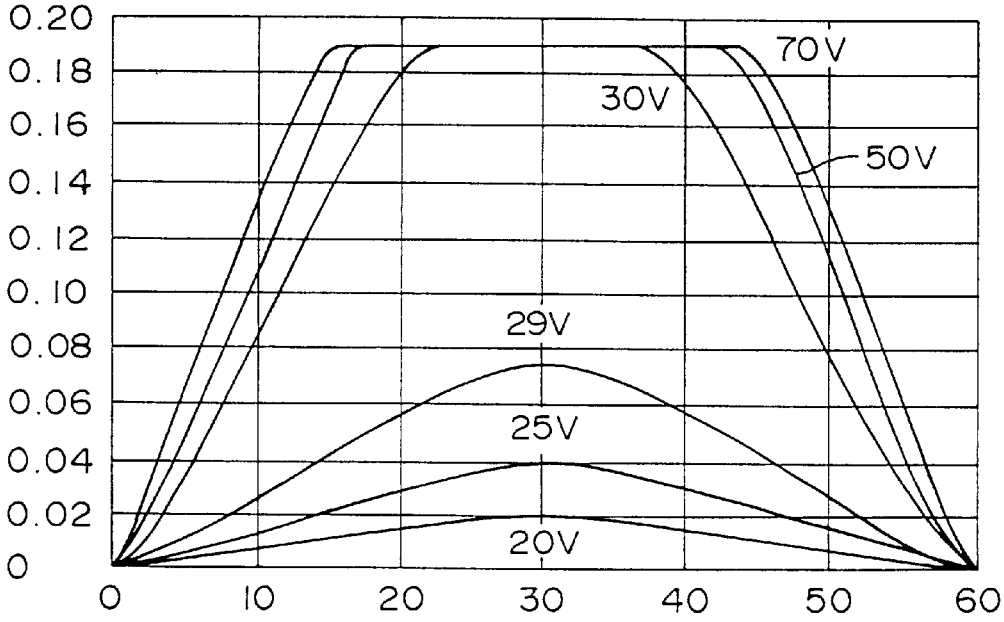
FIG. 10 is a schematic diagram showing a relationship between a drive voltage applied to the electrode and an amount of displacement of the diaphragm in the transverse direction.
Figure 11:
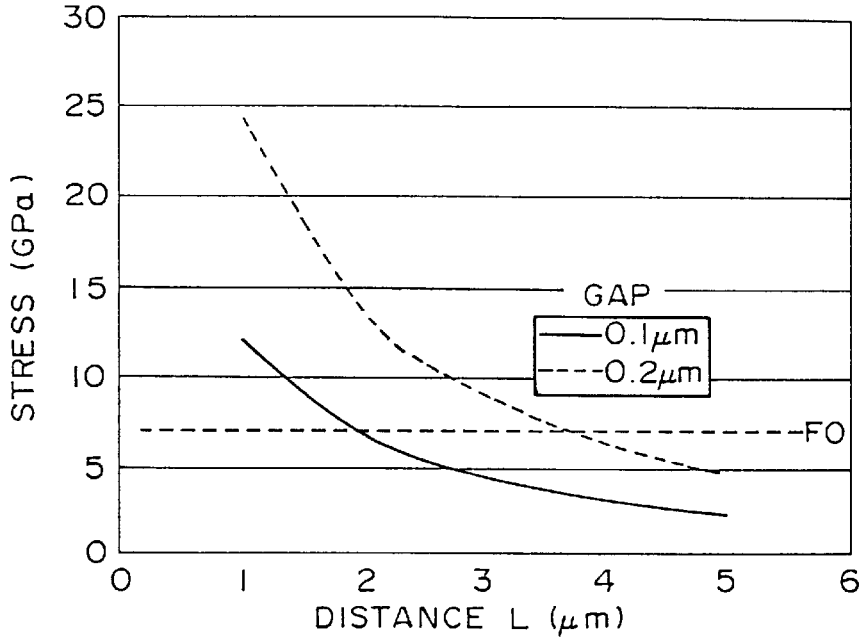
FIG. 11 is a graph showing a variation in a stress generated in the diaphragm when a distance between an edge of the diaphragm and an edge of the electrode when the electrode is vertically projected onto the diaphragm in a case in which the diaphragm contacts the entire electrode in the transverse direction.
Figure 12:
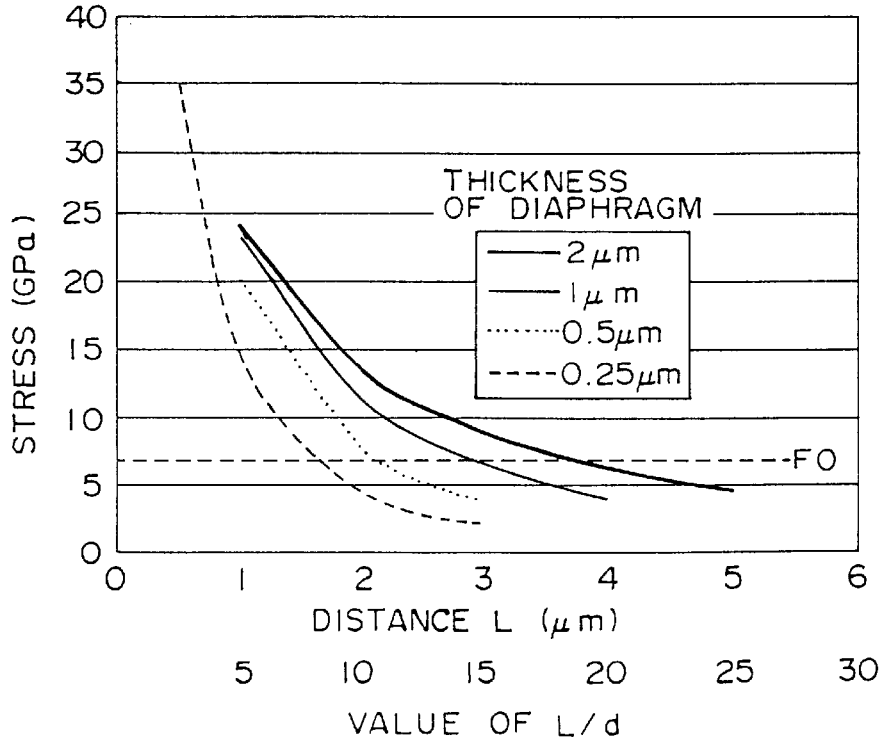
FIG. 12 is a graph showing a relationship between a stress of the diaphragm and the distance between an edge of the diaphragm and an edge of the electrode when the electrode is vertically projected onto the diaphragm.

A description will now be provided, with reference to FIGS. 9 through 12, of the positional relationship between the diaphragm 8 and the electrode 11 or 11A. FIG. 9 is a schematic diagram showing an amount of displacement of a diaphragm when the diaphragm is driven by a contact drive method and a non-contact drive method in a case in which the same amount of ink is discharged from the inkjet head. FIG. 10 is a schematic diagram showing a relationship between a drive voltage applied to the electrode and an amount of displacement of the diaphragm in the transverse direction. FIG. 11 is a graph showing a variation in a stress generated in the diaphragm when a distance between an edge of the diaphragm and an edge of the electrode when the electrode is vertically projected onto the diaphragm when the diaphragm is arranged to contact the entire electrode in the transverse direction. FIG. 12 is a graph showing a relationship between a stress of the diaphragm and the distance between an edge of the diaphragm and an edge of the electrode when the electrode is vertically projected onto the diaphragm.

According to the contact drive method, an amount of displacement of the diaphragm is larger than that of the diaphragm driven by the non-contact drive method in a case in which the same amount of ink is discharged. The amount of displacement of the diaphragm is particularly large at points indicated by arrows in FIG. 9. That is, the amount of displacement of the diaphragm is large at four points corresponding to the opposite ends in the transverse direction and ends of an area in which the diaphragm contacts the electrode. Accordingly, damage to and destruction of the diaphragm tends to occur at these four points.

Accordingly, in order to prevent fracture of the diaphragm, particularly to prevent fatigue fracture, the amount of deformation of the diaphragm at the above-mentioned four points must be reduced. In order to do so, the deformation of the diaphragm when driven by the contact drive method was analyzed.

The analysis of the deformation of the diaphragm was achieved by a numerical simulation of a relationship between the drive voltage applied to the electrode and the deformation of the diaphragm. The results are shown in FIG. 10. Each curve in FIG. 10 represents a contour of a cross section of the diaphragm taken along the transverse direction. The curves correspond to various drive voltages applied to the electrode. Accordingly, the horizontal axis of FIG. 10 represents a position of the diaphragm along the transverse direction, and the vertical axis represents a distance between the electrode and the diaphragm.

The results shown in FIG. 10 were results of a static analysis. In the analysis model, a length of each of the diaphragm and the electrode was infinite; a width of each of the diaphragm and the electrode was about 60 $\mu$m; a thickness of each of the diaphragm and the electrode was about 2 $\mu$m; a distance between the diaphragm and the electrode was about 0.2 $\mu$m; and the material of the diaphragm was silicon.

It is seen from FIG. 10 that the deformation of the diaphragm sharply changes between the drive voltages of approximately 29 V and 30 V. At the drive voltage of about 30 V, the center of the diaphragm contacts the electrode, as well as, a diaphragm portion (contacting area) having a certain width contacts the electrode. At a voltage higher than about 30 V, the contact area expands as the drive voltage applied to the electrode increases. However, the rate of expansion of the contact area decreases as the drive voltage increases. The deformation of the diaphragm is proportional to the drive voltage applied to the electrode.

Although the simulation was ended after the drive voltage was raised to about 70 V, it was assumed that the contact area will expand at a further higher voltage, and will extend to the entire width of the electrode if fracture does not occur in the diaphragm.

According to the above-mentioned results, it was determined that the deformation of the diaphragm can be reduced by decreasing the drive voltage, and an influence of fluctuation in the drive voltage is increased as the drive voltage is decreased. For example, if an attempt is made to limit the fluctuation in the deformation to an order of a few hundreds ppm with respect to the fluctuation in the drive voltage of ±1 V, the drive voltage must be set to about 50V to about 70 V. Accordingly, it was concluded that the mere adjustment of the drive voltage cannot reduce the influence by the fluctuation in the drive voltage.

Then, an attempt was made to reduce the width of the electrode. For example, the width of the electrode was reduced to a width of the contact area of the diaphragm when the drive voltage is about 30 V. In this case, when a voltage higher than about 30 V, for example about 70 V, is applied to the electrode, the deformation of the diaphragm was almost the same as that when about 30 V is applied to the electrode. Additionally, the influence of the fluctuation of the voltage which influence is given to the deformation of the diaphragm is reduced to or further reduced than that of the original model with the drive voltage of 70 V being applied to the electrode.

That is, by reducing the width of the electrode to be smaller than the width of the diaphragm, the deformation of the diaphragm can be reduced, and the influence caused to the deformation by the fluctuation in the drive voltage can also be reduced.

The deformation of the diaphragm having the reduced width can be considered with a graph shown in FIG. 11. FIG. 11 shows a relationship between a Mises stress of the diaphragm and the distance L between an edge of the diaphragm and an edge of the electrode when the electrode is vertically projected onto the diaphragm. The values shown in FIG. 11 were obtained by a simulation which was based on the assumption that the drive voltage is sufficiently large and the diaphragm is forcibly deformed to contact the entire width of the electrode.

The horizontal axis of the graph of FIG. 11 represents the distance L between an edge of the diaphragm and an edge of the electrode when the electrode is vertically projected onto the diaphragm, and the vertical axis represents the Mises stress generated in the diaphragm. The simulation was performed in accordance with a two-dimensional FEM static analysis. In the simulation, the material of the diaphragm was silicon; the diaphragm and the electrode were substantially parallel to each other; the thickness of the diaphragm was about 2 $\mu$m; and the distance d between the diaphragm and the electrode was about 0.2 $\mu$m and about 0.1 $\mu$m.

As is clear from FIG. 11, when the thickness of the diaphragm is the same, the Mises stress of the diaphragm is determined by the ratio Ud of the distance d (=0.2 $\mu$m) between the electrode and the diaphragm to the distance L between the edge of the electrode and the edge of the diaphragm. If the ratio L/d is greater than zero, the advantageous effects of preferred embodiments of the present invention can be obtained, and the effect to reduce the deformation of the diaphragm is increased as the ratio L/d is increased.

As a target value of the ratio L/d, there are two specific values.

The first value as a minimum value of the ratio L/d can be obtained from the yield stress of the diaphragm. That is, the first value of the ratio Ud is a minimum value at which fracture does not occur in the diaphragm.

FIG. 12 is a graph similar to the graph of FIG. 11. That is, the graph of FIG. 12 shows a relationship between a Mises stress of the diaphragm and the distance L between an edge of the diaphragm and an edge of the electrode when the electrode is vertically projected onto the diaphragm. The thickness of the diaphragm was approximately 0.2 $\mu$m, 0.5 $\mu$m, 1$\mu$m, and 2 $\mu$m. The horizontal axis of the graph of FIG. 12 represents the distance L between an edge of the diaphragm and an edge of the electrode when the electrode is vertically projected onto the diaphragm, and the vertical axis represents the Mises stress generated in the diaphragm. The simulation was performed in accordance with a two-dimensional FEM static analysis. In the simulation, the material of the diaphragm was silicon; the diaphragm and the electrode were substantially parallel to each other; the thickness of the diaphragm was about 2 $\mu$m; and the distance d between the diaphragm and the electrode was about 0.2 $\mu$m.

It can be appreciated from FIG. 12 that the Mises stress tends to be decreased as the thickness of the diaphragm is decreased even when the ratio L/d is the same. The minimum thickness of the diaphragm which can be presently made is about 0.25 $\mu$m while the yield stress FO of the single crystal silicon is about 7 Gpa as shown in FIG. 12. Accordingly, in order to prevent fracture of the diaphragm, it can be appreciated from FIG. 12, that a minimum value for the ratio L/d should be about 10.

The second value of the ratio L/d is determined based on the condition in which fatigue fracture does not occur in a practical range of the thickness of the diaphragm and of the drive voltage applied to the electrode.

A vibration withstand test was performed on an electrostatic actuator having a diaphragm with a thickness of about 2 $\mu$m. The frequency of vibration was an order of tenth power of 10 ($10^{10}$). In the test, no fatigue fracture was observed at the drive voltage of about 30 V. The fatigue fracture was observed at about 50 V and all of the specimen of the diaphragm fractured at the drive voltage of about 70 V. The fracture occurs at positions corresponding to the points indicated by arrows in FIG. 9. With respect to the position at which the fracture occurs as far as the longitudinal direction of the diaphragm is concerned, most fracture occurs at positions within a range from about 1/10 to about 1/3 of the length of diaphragm from the end of the diaphragm.

Considering the above-mentioned results of the vibration test and the results shown in FIG. 10, the effect to prevent the deformation is clear when the ratio L/d is equal to or greater than about 50. When the ratio L/d is equal to or greater than about 80, the effect becomes remarkable. Thus, as mentioned above, it is preferable that the relationship $L/d \geqq 50$ is satisfied, and more preferably the relationship L/d $L \geqq 80$ is satisfied.

According to the results described above, in the inkjet head according to the first preferred embodiment of the present invention, the width of the electrode 11 is preferably smaller than the width of the electrode 11 and the entire width of the electrode is within the width of the diaphragm when the electrode 11 is vertically projected onto the diaphragm 8.

Additionally, as shown in FIG. 4, the ratio L/d is set to a value equal to or greater than about 10 ($L/d \geqq 10$) so as to prevent immediate fracture of the diaphragm 8. The ratio L/d is preferably set to a value equal to or greater than about 50 ($L/d \geqq 50$) so as to prevent fatigue fracture of the diaphragm 8.

The above consideration regarding the fracture of the diaphragm is related to the transverse direction. However, fracture occurs at a position related to the longitudinal direction of the diaphragm. Accordingly, the positional relationship between the diaphragm 8 and the electrode 11 in the transverse direction should be applied also to the positional relationship in the 5 longitudinal direction of the electrode.

Accordingly, in the inkjet head according to the first preferred embodiment of the present invention, one of the ends (left side end in FIG. 3) of the electrode 11 is offset inwardly from the corresponding end of the diaphragm 8 when the electrode is vertically projected onto the diaphragm 8.

In the inkjet head according to the second preferred embodiment of the present invention, the positional relationship is applied to both ends of the electrode 11A since the entire electrode 11A is situated within the diaphragm 8 when the electrode 11A is vertically projected onto the diaphragm 8.

In the first and second preferred embodiments of the present invention, an excessive deformation of the diaphragm 8 can be prevented by the above-mentioned construction of the actuator when a sufficiently large voltage, which causes more than a half of the diaphragm 8 contacts the electrode 11 or 11A, is applied to the electrode 11 or 11A while the influence of the fluctuation in the drive voltage to the deformation of the diaphragm 8 is minimized.

Figure 13:
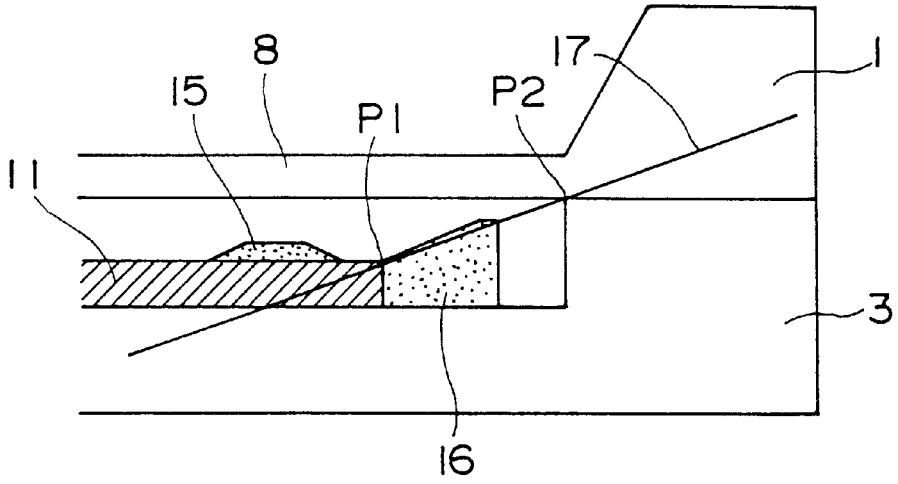
FIG. 13 is a schematic illustration of a portion of an inkjet head according to a third preferred embodiment of the present invention.

A description will now be provided, with reference to FIG. 13, of a third preferred embodiment of the present invention. FIG. 13 is a schematic illustration of a portion of an inkjet head according to the third preferred embodiment of the present invention. In FIG. 13, elements that are the same as the elements shown in FIG. 4 are indicated by given the same reference numerals, and descriptions thereof will be omitted. It should be noted that FIG. 13 corresponds to FIG. 4 or FIG. 8.

In the present preferred embodiment shown in FIG. 13, a first protrusion 15 is preferably provided on the electrode 11 and a second protrusion 16 is located adjacent to the side of the electrode 11. The first protrusion 15 and the electrode 11 are preferably made of a conductive material.

When the width of the electrode 11 is small, an electrostatic force mostly depends on an area of the electrode 11 which the diaphragm 8 contacts after the diaphragm 8 is caused to contact the electrode 11. Thus, if the contacting area is the same, the electrostatic force is not influenced by the area of the electrode 11. However, a voltage necessary for the diaphragm 8 to contact the electrode 11 is decreased in proportion to the area of the electrode 11.

Thus, in order to decrease a voltage necessary for the diaphragm 8 to contact the electrode 11, the first protrusion 15 is provided on the electrode 11. That is, the diaphragm 8 attracted by the electrode 11 contacts the protrusion 15 before the diaphragm 8 contacts the electrode 11. That is, the first protrusion 15 substantially reduces the distance between the diaphragm 8 and the electrode 11.

The second protrusion 16 functions similarly to the first protrusion 15, and provides the same effect as the first protrusion 15. A top surface of the second protrusion 16 is preferably higher than a line connecting the points P1 and P2 as shown in FIG. 13. If the top surface of the protrusion is lower than the line connecting the points P1 and P2, the effect to reduce the drove voltage necessary for the diaphragm 8 to contact the electrode 11 is small, and the deformation of the diaphragm 8 becomes large. It should be noted that an insulating layer which is preferably the same as the insulating layer 12 made of $SiO_2$ may be provided on the first protrusion 15 and the second protrusion 16 so that the first protrusion 15 and the second protrusion 16 are prevented from being damaged due to short-circuit or a discharge.

It should be noted that the first and second protrusions 15 and 16 can be applied to the electrode 11A provided in the inkjet head according to the second preferred embodiment.

Figure 14:
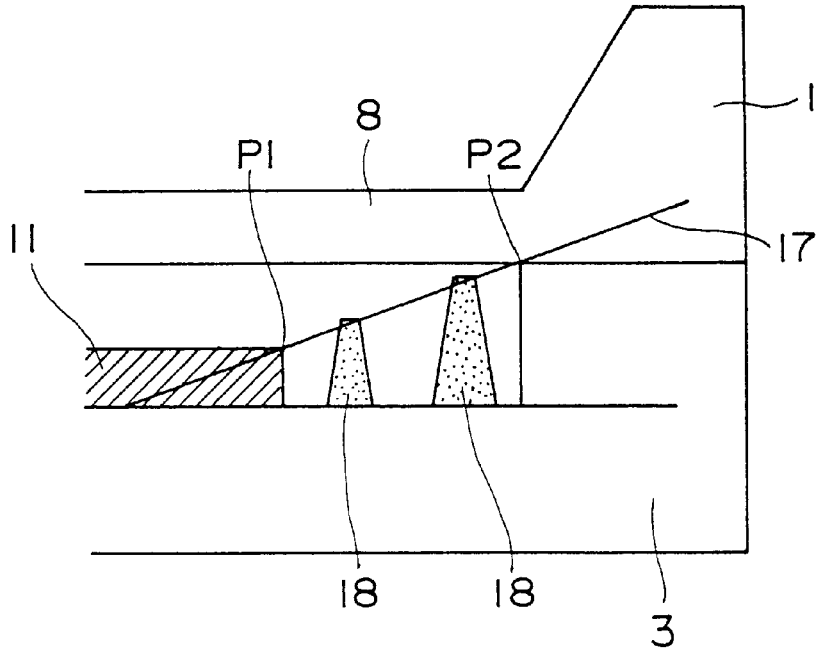
FIG. 14 is a schematic illustration of a portion of an inkjet head according to a third preferred embodiment of the present invention.

A description will now be provided, with reference to FIG. 14, of a fourth preferred embodiment according to the present invention. FIG. 14 is a schematic illustration of a portion of an inkjet head according to the fourth preferred embodiment of the present invention. In FIG. 14, elements that are the same as the elements shown in FIG. 4 are indicated by the same reference numerals, and descriptions thereof will be omitted. It should be noted that FIG. 13 corresponds to FIG. 4 or FIG. 8.

In this preferred embodiment, a plurality of protrusions 18, each of which is made of an insulating material, are provided around the electrode 11 so that the protrusions 18 face the diaphragm 8.

As mentioned above, when the width of the electrode 11 is smaller than the width of the diaphragm 8, an empty space is formed around the electrode 11. The protrusions 18 are formed in the empty space provided for freedom of design. The protrusions 18 are arranged to limit the displacement of the diaphragm so as to reduce an influence of a fluctuation in the drive voltage. To this end, a top surface of each of the protrusions 18 is preferably higher than a line connecting the point P1 and the point P2. If the top surface of each of the protrusions 18 is lower than the line connecting the point P1 and point P2, the diaphragm may not contact the protrusions 18, and the desired effect of the protrusions 18 cannot be realized.

Additionally, by providing the protrusions 18, a volume of the empty space between the diaphragm 8 and the electrode substrate 3 is reduced, and movement of air in the empty space is restricted. Thereby, the repulsion effect of the air in the empty space can be provided to the movement of the diaphragm 8.

Figure 15:
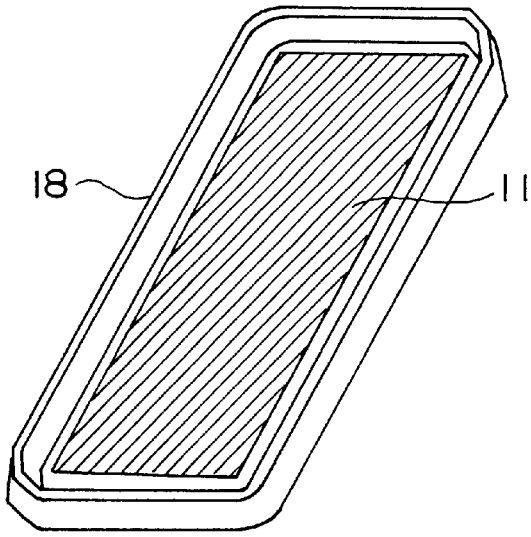
FIG. 15 is a perspective view of an example of a protrusion shown in FIG. 14.
Figure 16:
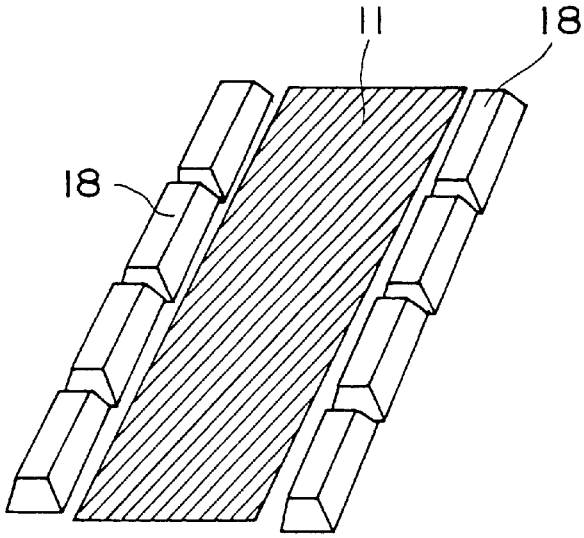
FIG. 16 is a perspective view of another example of the protrusion shown in FIG. 14.

In this case, a remarkable effect can be obtained by constructing the protrusions 18 to define a wall surrounding the electrode 11. For example, as shown in FIG. 15, the protrusion 18 may be a wall-like continuous member which surrounds the electrode 11. Alternatively, as shown in FIG. 16, the protrusions 18 may be a plurality of blocks consecutively arranged around the electrode 11. In this case, the repulsion characteristic of the air in the empty space can be controlled by changing the height or thickness of each of the blocks or a distance between the blocks. The repulsion characteristic may be adjusted by changing the position of the blocks with respect to the electrode 11 so as to change the volume of a space outside the protrusions 18.

It should be noted that the protrusions 18 can be applied to the electrode 11A provided in the inkjet head according to the second preferred embodiment.

Figure 17:
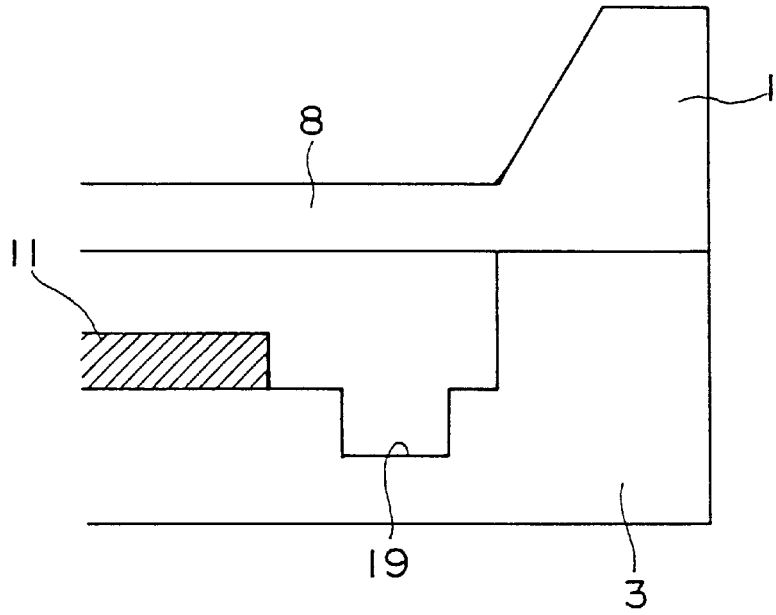
FIG. 17 is a schematic illustration of a portion of an inkjet head according to a fifth preferred embodiment of the present invention.

A description will now be provided, with reference to FIG. 17, of a fifth preferred embodiment according to the present invention. FIG. 17 is a schematic illustration of a portion of an inkjet head according to the fifth preferred embodiment of the present invention. In FIG. 17, elements that are the same as the elements shown in FIG. 4 are indicated by the same reference numerals, and descriptions thereof will be omitted. It should be noted that FIG. 17 corresponds to FIG. 4 or FIG. 8.

In this preferred embodiment, a groove or depression 19 is formed in an area of the electrode substrate 3 surrounding the electrode 11. The groove or depression 19 is provided when the repulsion force of the air in the empty space surrounding the electrode 11 is too high. That is, the groove or depression 19 acts to reduce a repulsion effect of the air in the empty space surrounding the electrode 11.

It should be noted that the groove or depression 19 can be applied to the electrode 11A provided in the inkjet head according to the second preferred embodiment.

Figure 18:
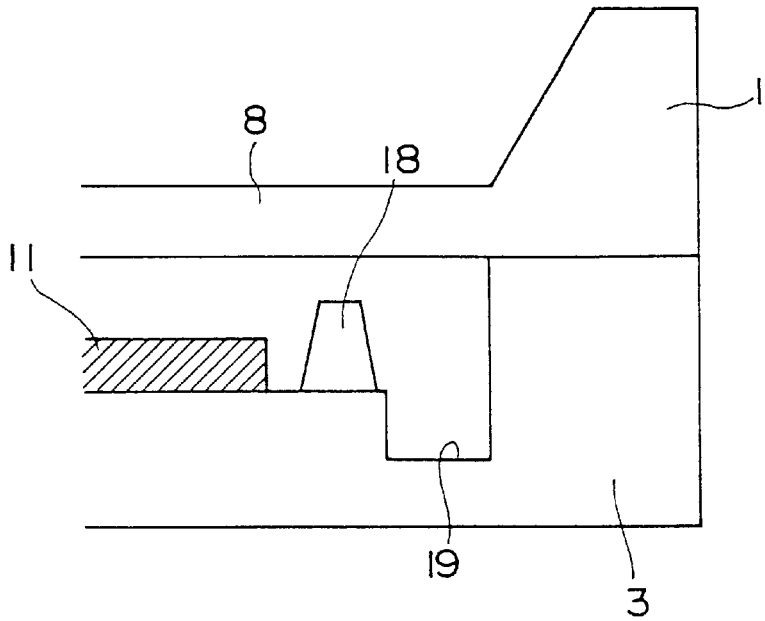
FIG. 18 is a schematic illustration of a portion of an inkjet head according to a sixth preferred embodiment of the present invention.

A description will now be provided, with reference to FIG. 18, of a sixth preferred embodiment according to the present invention. FIG. 18 is a schematic illustration of a portion of an inkjet head according to the sixth preferred embodiment of the present invention. In FIG. 18, elements that are the same as the elements shown in FIG. 4 are indicated by the same reference numerals, and descriptions thereof will be omitted. It should be noted that FIG. 18 corresponds to FIG. 4 or FIG. 8.

In this preferred embodiment, the protrusion 18 is provided in the empty space surrounding the electrode 11 and the groove or depression 19 is formed in an area of the electrode substrate 3 surrounding the protrusion 18. By providing both the protrusion 18 and the groove or depression 19, precise control of the repulsion force can be achieved since the effects of the fourth and fifth preferred embodiments are combined. That is, the repulsion force is not only simply increased or decreased but also the repulsion characteristic can be changed as the displacement of the diaphragm 8 progresses.

It should be noted that the combination of the protrusion 18 and the groove or depression 19 can be applied to the electrode 11A provided in the inkjet head according to the second preferred embodiment.

Figure 19:
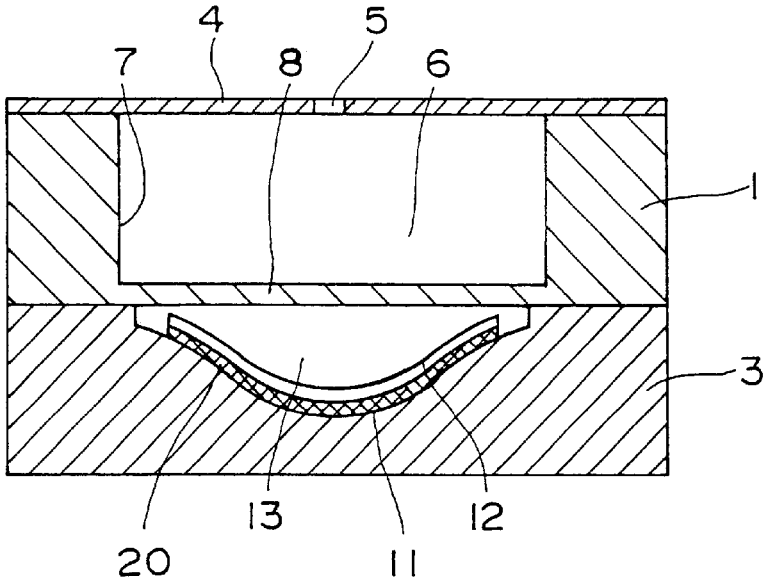
FIG. 19 is a cross-sectional view of a portion of the inkjet head according to a seventh preferred embodiment of the present invention.

A description will now be provided, with reference to FIG. 19, of a seventh preferred embodiment of the present invention.

In the above-mentioned preferred embodiments, the electrode 11 or 11A is flat and the diaphragm 8 is substantially parallel to the electrode 11 or 11A. However, the electrode 11 or 11A is not limited to the flat shape, and a curved shape or other suitable shapes can be used for the electrode 11 or 11A.

FIG. 19 is a cross-sectional view of a portion of an inkjet head according to the seventh preferred embodiment of the present invention. In FIG. 19, elements that are the same as the elements shown in FIG. 2 are indicated by the same reference numerals, and descriptions thereof will be omitted. FIG. 19 is a cross-sectional view taken along the transverse direction of the electrode 11.

In this preferred embodiment, the electrode 11 is curved so that the center of the electrode 11 is depressed. The curve of the surface of the electrode 11 has a curvature changing point 20 at which the curvature is changed from convex to concave. Thus, the contour of the air gap between the diaphragm 8 and the electrode 11 (insulating layer 12) has a curvature changing point at which the curvature is changed from convex to concave.

A Gaussian curve is suitable for the curve having the curvature changing point. In such a structure, a contour of the diaphragm 8 starts to move first toward the electrode 11 which part is closest to the electrode 11. Thus, the diaphragm 8 can be displaced at a lower voltage which results in a reduction in the drive voltage to be applied to the electrode 11.

Figure 20:
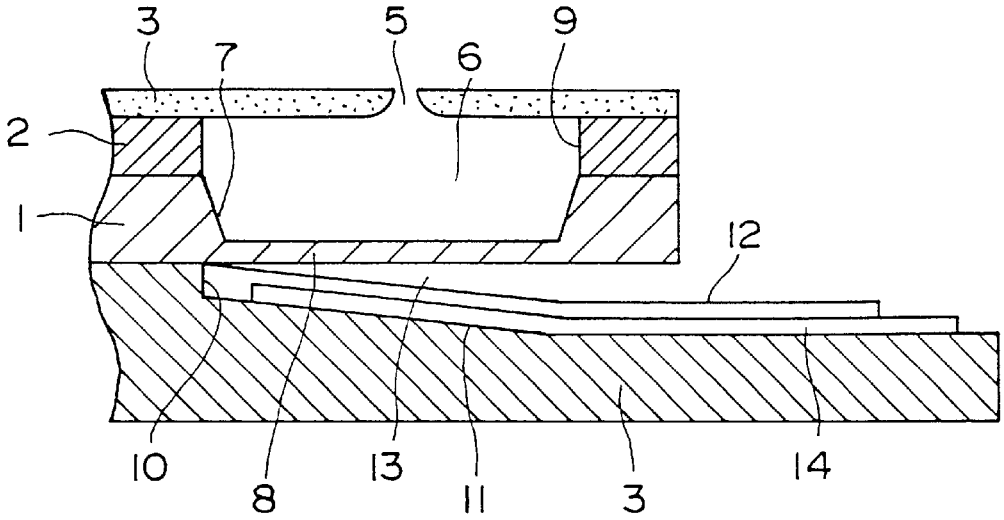
FIG. 20 is a cross-sectional view of a portion of the inkjet head according to an eighth preferred embodiment of the present invention.

A description will now be provided, with reference to FIG. 20, of an eighth preferred embodiment of the present invention. FIG. 20 is a cross-sectional view of a portion of an inkjet head according to the eighth preferred embodiment of the present invention. In FIG. 20, elements that are the same as the elements shown in FIG. 1 are indicated by the same reference numerals, and descriptions thereof will be omitted. FIG. 20 is a cross-sectional view taken along the longitudinal direction of the electrode 11.

In the present preferred embodiment, although the electrode 11 is shown as being flat, the diaphragm 8 and the electrode 11 are not parallel to each other. That is, as shown in FIG. 20, the electrode 11 is inclined with respect to the diaphragm 8. Similar to the seventh preferred embodiment of the present invention, the displacement of the diaphragm 8 can be initiated at a part which is closest to the electrode 11. Thus, the same effect as the seventh preferred embodiment can be obtained.

Figure 21:
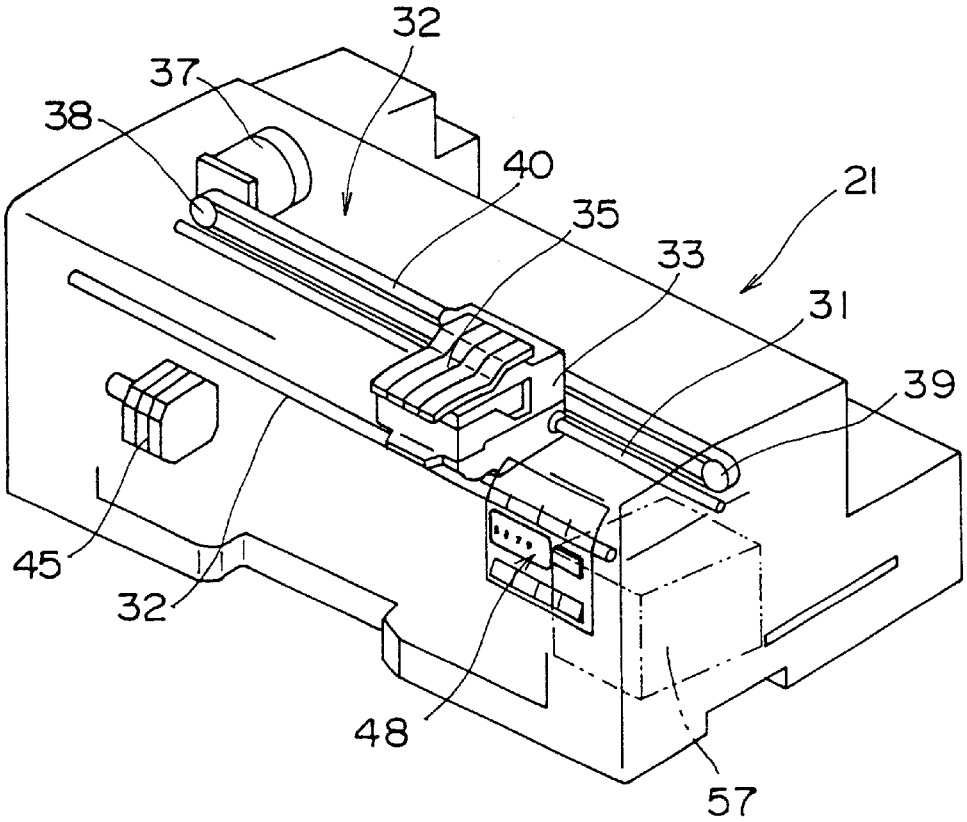
FIG. 21 is a perspective view of an inkjet recording apparatus provided with the inkjet head according to one of the preferred embodiments of the present invention.
Figure 22:
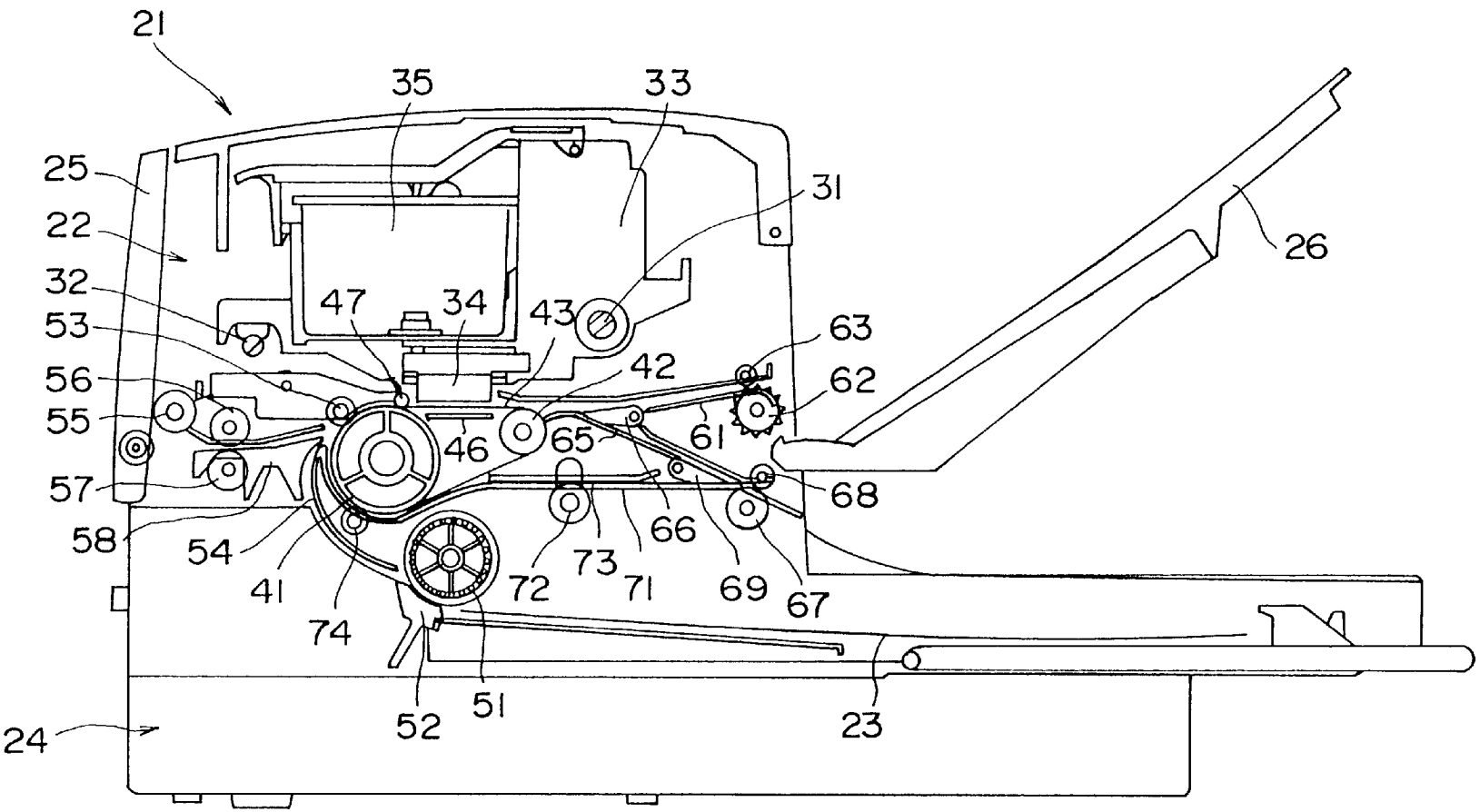
FIG. 22 is a side view of the inkjet recording apparatus shown in FIG. 21.

A description will now be provided, with reference to FIGS. 21 and 22, of an inkjet recording apparatus provided with the inkjet head according to one of the preferred embodiments of the present invention. FIG. 21 is a perspective view of the inkjet recording apparatus provided with the inkjet head according to one of the preferred embodiments of the present invention. FIG. 22 is a side view of the inkjet recording apparatus shown in FIG. 21.

The inkjet recording apparatus preferably includes an apparatus body 21 which is provided with a print mechanism 22. The print mechanism 22 preferably includes a carriage 33 movable in primary scanning directions, a recording head 34 including an inkjet head mounted on the carriage 33 and an ink cartridge 35 for supplying ink to the inkjet head. A recording paper supply cassette 24 is detachably attached to a bottom of the apparatus body 21. A manual feed tray 25 is rotatably supported on a front part of the apparatus body 21. A recording paper 23 is supplied from the recording paper supply cassette 24 or the manual feed tray 25. A print image is formed on the recording paper 23 by the print mechanism 22, and the recording paper 23 is ejected onto an eject tray 26 provided on a backside of the apparatus body 21. An operational panel 28 is provided on the front side of the apparatus body 21.

The print mechanism 22 has a main guiding rod 31 and a sub guiding rod 32 that rotatably support the carriage 33 in the primary scanning directions. The inkjet head of the recording head 34 has nozzles that eject droplets of yellow (Y), cyan (C), magenta (M) and black (Bk) ink toward the recording paper 23. The inkjet head has a structure according to one of the preferred embodiments of the present invention. The recording head 34 is situated under the carriage 33. The ink cartridge 35 is situated above the carriage 33.

The carriage 33 is movable in the primary scanning directions by a timing belt 40 which is provided between a drive pulley 38 rotated by a primary scanning motor 37 and an idle pulley 39.

The recording paper 23 is attached on a conveyor belt 43 by an electrostatic force, and is fed in a sub scanning direction. The conveyor belt 43 is provided between a conveyor roller 41 and an idle conveyor roller 42. The conveyor roller 41 is rotated by a sub scanning motor via a train of gears (not shown in the figure).

A print support plate 46 is provided on the opposite side of the recording head 34 with respect to the conveyor belt 43. A roller 47 is pressed against the conveyor.roller 41 via the conveyor belt 43 so as to determine a feed angle of the conveyor roller 41.

A supply roller 51 and a friction pad 52 are provided to supply the recording paper 23 from the recording paper supply cassette 24 to the conveyor belt 43. The supplied recording paper 23 is fed to an intermediate roller 53 while being guided by the guide member 54 which presses the recording paper 23 against the conveyor roller 23.

In order to supply the recording paper 23 from the manual feed tray to the conveyor belt 43, the recording paper 23 set in the manual feed tray 25 is picked up by a pickup roller 55. The picked up recording paper 23 is fed by feed rollers 56 and 57. Then, the recording paper 23 is fed to the intermediate roller 53 while being guided by a guide member 58.

The recording paper 23 after completion of printing is completed is guided by a guide member 61, and is ejected onto an eject tray 26 by being fed by an eject roller 26 and an idle eject roller 63.

Additionally, the recording paper 23 after the completion of printing is supplied to the conveyor roller 43 again so as to print an image on the back side of the recording paper 23, if it is necessary. In order to do so, the recording paper 23 passing by the recording head 43 is guided by a guide member 65 in a diagonally downward direction. A first branch claw 66 is rotatably supported on the guide member 65 near an eject guide member 61 so as switch the path of the recording paper 23.

The recording paper 23 guided by the guide member 65 is ejected onto the top surface of the recording paper supply cassette 24 and is fed into the apparatus body 21 again by a switchback roller 67 and a switchback idle roller 68. The switchback roller 67 is rotated in a normal direction when the recording paper 23 is fed in an ejecting direction, and is rotated in a reverse direction when the recording paper 23 is supplied into the apparatus body 21 again after being stopped at a predetermined timing so as to catch the trailing edge of the recording paper 23.

Additionally, a second branch claw 69 is rotatably supported on the upstream side of the switchback roller 67 and the switchback idle roller 68. The second branch claw 69 switches the path of the recording paper 23 between the ejecting path to outside and the return path to the inside of the apparatus body 21. The recording paper 23 is fed to the convey roller 43 by a relay roller 72 and a relay idle roller 73 by being guided by a guide member 71. The recording paper 23 after reaching the convey roller 43 is fed to the intermediate roller 53 by an idle roller 74.

It should be noted that present invention may be applicable to an electrostatic inkjet head using a non-contact drive method. Additionally, the actuator according to the present invention may be used as an actuator for discharging a liquid such as a medical liquid.

The present invention is not limited to the preferred embodiments specifically disclosed herein, and variations and modifications may be made without departing from the scope of the present invention.

The present application is based on Japanese Priority Applications No. 10-358333 filed on Dec. 17, 1998 and No. 11-297982 filed on Oct. 20, 1999, the entire contents of which are hereby incorporated by reference.

What is claimed is:

1. An electrostatic actuator comprising:

a diaphragm having a structure that is elastically deformable by an electrostatic force; and an electrode facing said diaphragm with a predetermined air gap being defined therebetween so as to generate the electrostatic force, said electrode having a width that is smaller than a width of said diaphragm at all points along a longitudinal direction of said electrode, said electrode being situated within said diaphragm in a direction of the width of said electrode when said electrode is vertically projected onto said diaphragm.

2. The electrostatic actuator as claimed in claim 1, wherein a length d of the air gap at a point p1 along a side of a top surface of said electrode and a distance L between the point p1 and a point p2 along a side of said diaphragm satisfy a relationship $L/d \geqq 10$.

3. The electrostatic actuator as claimed in claim 2, wherein an insulating layer is disposed on said electrode, and the length d is defined as a distance between said insulating layer and said diaphragm.

4. The electrostatic actuator as claimed in claim 1, wherein a length d of the air gap at a point p1 along a side of a top surface of said electrode and a distance L between the point p1 and a point p2 along a side of said diaphragm satisfy a relationship $L/d \geqq 50$.

5. The electrostatic actuator as claimed in claim 4, wherein an insulating layer is disposed on said electrode, and the length d is defined as a distance between said insulating layer and said diaphragm.

6. The electrostatic actuator as claimed in claim 1, wherein when said electrode is vertically projected onto said diaphragm, all portions of the projected electrode is situated within said diaphragm.

7. The electrostatic actuator as claimed in claim 6, wherein a length d of the air gap at a point p1 along a side of a top surface of said electrode and a distance L between the point p1 and a point p2 along a side of said diaphragm satisfy a relationship $L/d \geqq 10$.

8. The electrostatic actuator as claimed in claim 7, wherein an insulating layer is disposed on said electrode, and the length d is defined as a distance between said insulating layer and said diaphragm.

9. The electrostatic actuator as claimed in claim 6, wherein a length d of the air gap at a point p1 along a side of a top surface of said electrode and a distance L between the point p1 and a point p2 along a side of said diaphragm satisfy a relationship $L/d \geqq 50$.

10. The electrostatic actuator as claimed in claim 9, wherein an insulating layer is disposed on said electrode, and the length d is defined as a distance between said insulating layer and said diaphragm.

11. The electrostatic actuator as claimed in claim 1, further comprising a protrusion disposed on said electrode, said protrusion being made of a conductive material.

12. The electrostatic actuator as claimed in claim 1, further comprising a protrusion located adjacent to said electrode, said protrusion being made of a conductive material, said protrusion having a top surface higher than a line connecting a point p1 along a side of a surface of said electrode and a point p2 along a side of said diaphragm.

13. The electrostatic actuator as claimed in claim 1, further comprising a protrusion adjacent to said electrode so that a top surface of said protrusion faces said diaphragm, said protrusion being made of an insulating material.

14. The electrostatic actuator as claimed in claim 13, wherein said top surface of said protrusion is higher than a line connecting a point p1 along a side of a surface of said electrode and a point p2 along a side of said diaphragm.

15. The electrostatic actuator as claimed in claim 13, wherein said protrusion surrounds said electrode.

16. The electrostatic actuator as claimed in claim 1, further comprising a depression formed in an area adjacent to said electrode so that said depression faces said diaphragm.

17. The electrostatic actuator as claimed in claim 1, further comprising:

a protrusion located adjacent to said electrode so that a top surface of said protrusion faces said diaphragm; and a depression formed in an area adjacent to said electrode so that said depression faces said diaphragm.

18. The electrostatic actuator as claimed in claim 1, wherein said diaphragm is elastically deformable by the electrostatic force by an amount that is proportional to an amount that said diaphragm contacts said electrode so that said diaphragm returns to an initial position thereof when the electrostatic force is removed.

19. The electrostatic actuator as claimed in claim 1, wherein said electrode is not parallel to said diaphragm so that deformation of said diaphragm is initiated at a position closest to said electrode.

20. An inkjet head for ejecting a droplet of ink from a nozzle, said inkjet head comprising:

a pressurizing chamber connected to said nozzle, said pressurizing chamber storing ink to be ejected from said nozzle; and an electrostatic actuator including a diaphragm having a structure that is elastically deformable by an electrostatic force, said diaphragm defining a wall of said pressurizing chamber; and an electrode facing said diaphragm with a predetermined air gap therebetween so as to generate the electrostatic force, said electrode having a width that is smaller than a width of said diaphragm at all points along a longitudinal direction of said electrode, said electrode being located within said diaphragm in a direction of the width of said electrode when said electrode is vertically projected onto said diaphragm.

21. An inkjet recording apparatus having an inkjet head for ejecting a droplet of ink from a nozzle, said inkjet head comprising:

a pressurizing chamber connected to said nozzle, said pressurizing chamber storing ink to be ejected from said nozzle; and an electrostatic actuator including:

a diaphragm having a structure that is elastically deformable by an electrostatic force, said diaphragm defining a wall of said pressurizing chamber; and an electrode facing said diaphragm with a predetermined air gap being defined therebetween so as to generate the electrostatic force, said electrode having a width that is smaller than a width of said diaphragm at all points along a longitudinal direction of said electrode, said electrode being located within said diaphragm in a direction of the width of said electrode when said electrode is vertically projected onto said diaphragm.

* * * * *